US006836988B2

(12) United States Patent
Zarelius

(10) Patent No.: US 6,836,988 B2
(45) Date of Patent: Jan. 4, 2005

(54) ARRANGEMENT UTILIZING A MAGNETIC ATTRACTIVE FORCE

(75) Inventor: Christer Zarelius, Stockholm (SE)

(73) Assignee: Expand International AB (SE)

( * ) Notice: Subject to any disclaimer, the term of this patent is extended or adjusted under 35 U.S.C. 154(b) by 0 days.

(21) Appl. No.: 10/276,831

(22) PCT Filed: May 14, 2001

(86) PCT No.: PCT/SE01/01050

§ 371 (c)(1),
(2), (4) Date: Apr. 14, 2003

(87) PCT Pub. No.: WO01/91092

PCT Pub. Date: Nov. 29, 2001

(65) Prior Publication Data

US 2004/0006902 A1 Jan. 15, 2004

(30) Foreign Application Priority Data

May 19, 2000 (SE) ..... 0001901

(51) Int. Cl.[7] ..... G09F 15/00
(52) U.S. Cl. ..... 40/610; 40/600; 40/661.01
(58) Field of Search ..... 428/156, 900, 428/692, 220; 40/661.01, 610, 600; 24/303; 427/128

(56) References Cited

U.S. PATENT DOCUMENTS 3,987,567 A * 10/1976 Fritts ..... 40/600
4,471,548 A 9/1984 Goudie ..... 40/610
5,388,382 A 2/1995 Brooks ..... 52/732.1
5,439,043 A 8/1995 Carter ..... 160/135
5,611,872 A * 3/1997 Manning et al. ..... 148/306
5,778,580 A * 7/1998 Zarelius ..... 40/610
5,994,990 A * 11/1999 Ogikubo ..... 335/285

FOREIGN PATENT DOCUMENTS

SE 469404 B 6/1993
WO WO 97/38411 10/1997

OTHER PUBLICATIONS

Profile Industrie "Chronoexpo2". Retrieved from the Internet: <URL:htt.//www.chronoexpo.com/site/index.html, no date.

* cited by examiner

*Primary Examiner*—Mark T. Le
(74) *Attorney, Agent, or Firm*—Ohlandt, Greeley, Ruggiero & Perle

(57) ABSTRACT

The present invention relates to an arrangement enabling edge-to-edge joining, by means of a magnetic attractive force, of a first edge portion 811*a*) of a first panel (11) in a display system to a second edge portion (12*b*) of a second panel (12), a first magnetised strip (11*e*) being applied to said first edge portion (11*a*) and a second magnetised strip (12*b*) being applied to said second edge portion (12*b*). The magnetised strips (11*e*, 12*d*) are assigned such magnetisation directions (s-n; n-s) that, in a position where the edge portions are in proximity and/or co-operating with each other, they assume a position attracted to each other. Said strips (11*e*, 12*d*) consist of a material different from the material of the panel (11, 12). The modulus of elasticity and the thickness (2600 MPa; 0.2 mm) of said panel (11) and the modulus of elasticity and the thickness (100 MPa; 0.7 mm) of said strips (11*e*, 12*d*) are such that only small axial stress related forces, or none at all, will act within the attachment means (50, 51). Said strips (11*e*, 12*d*) are assigned a thickness ("d") of less than 1.0 mm.

7 Claims, 2 Drawing Sheets

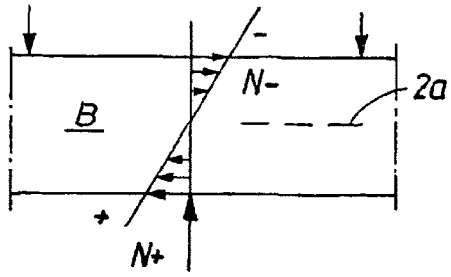
Fig. 1
Fig. 2
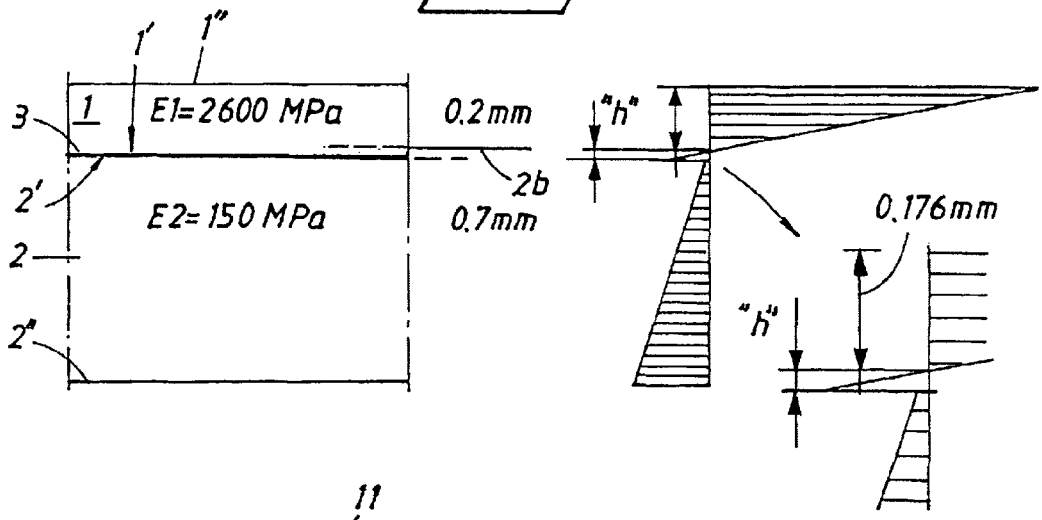
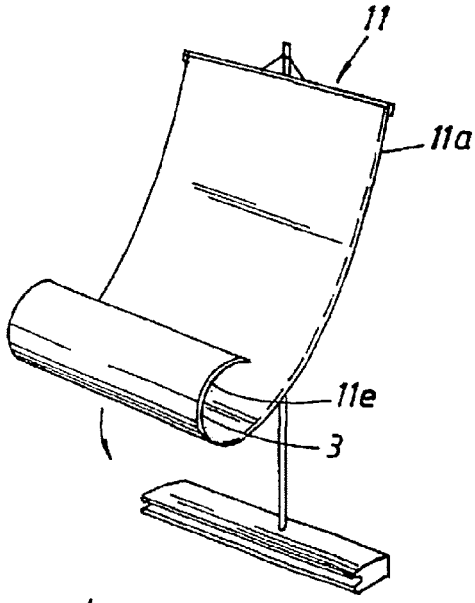
Fig. 3
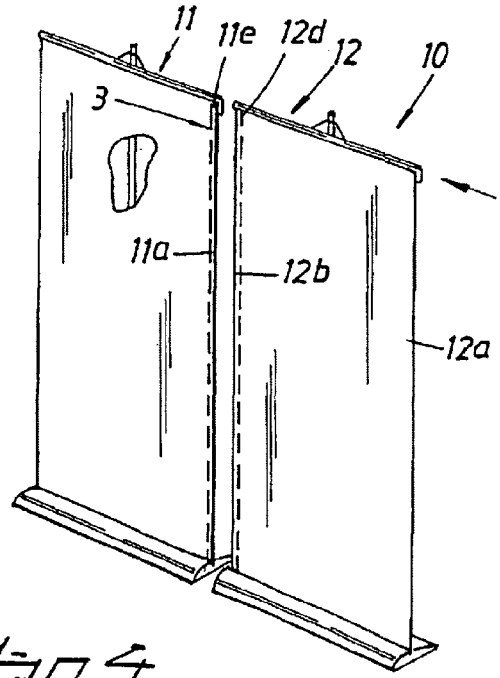
Fig. 4

Fig. 5
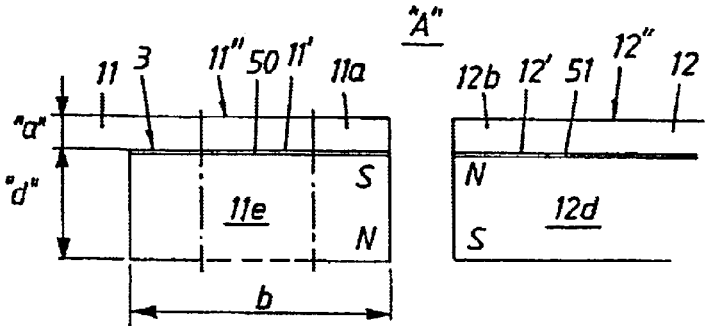
Fig. 6
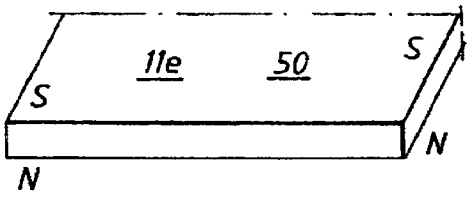
Fig. 7
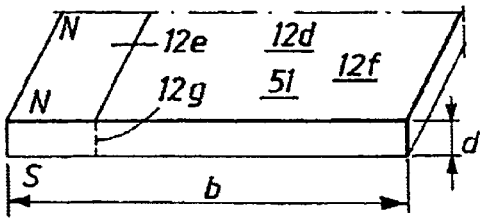
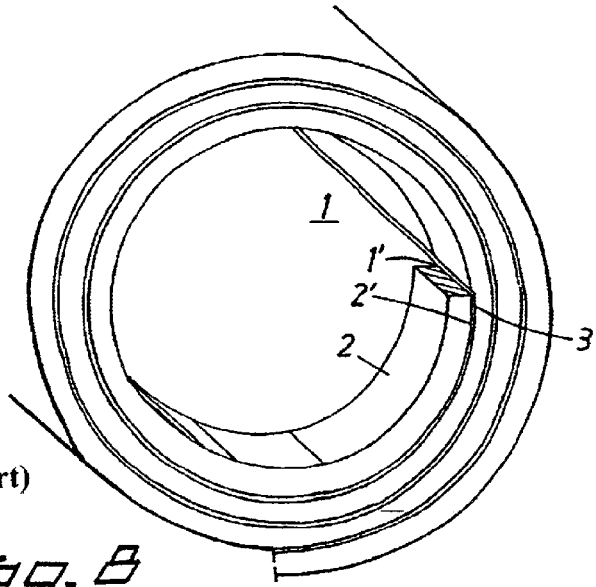
(Prior Art)
Fig. 8
Fig. 9
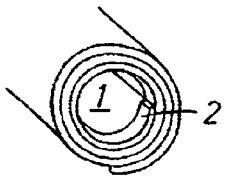

ARRANGEMENT UTILIZING A MAGNETIC ATTRACTIVE FORCE

TECHNICAL FIELD

The present invention relates generally to an arrangement based in principle on utilising a magnetic attractive force when it becomes operative between two permanently magnetised or magnetic strips.

More specifically the present invention relates to an arrangement enabling edge-to-edge joining or holding together, by means of a magnetic attractive force, of a first edge portion of a first panel in a display system to or against an opposed or second edge portion of a second panel.

The arrangement in accordance with the invention is also based on the principle of a first magnetised strip being applied to said first edge portion and a second magnetised strip being applied to said second edge portion, the edge-oriented magnetised strips being assigned such magnetisation directions that, in a position where the edge portions are in proximity and/or co-operating with each other, they assume a position strongly attracted to each other.

The principle of the invention is also based on said magnetised or magnetic strips consisting of a material or a material composition different from the material or material composition of the panel.

This choice of materials for the strip and for the panel requires the use of a means attaching the strip to the panel, said means being oriented close to said edge portions.

Said attachment means usually consists of an adhesive layer applied on the strip.

The present invention has been developed for the purpose of obtaining an application in a folding display arrangement or a display system comprising several panels.

Such a display arrangement may advantageously comprise of a plurality of base units that can be placed on, attached to or rest against a support surface, a sheet or panel that can be rolled or unrolled and may display a text, and/or pertain to each base unit, and a stand designed to support and retain the sheet or panel.

The expression "sheet or panel" refers primarily to a surface displaying a picture and/or text applied on a screen, a sheet of PVC or paper or other equivalent, thin carrier, the sheet material being so thin and thus flexible that it can be rolled and unrolled without the rolling or unrolling causing disturbing permanent deformation when unrolled to assume the form of a flat sheet or panel.

Only "panel" is used in the following description and this expression shall be understood in the first place to mean a thin sheet, without entirely excluding somewhat thicker and stiffer panels.

The invention also makes reference to a magnetic strip arrangement, which is adapted to co-operate with said panel or similar object in other applications.

BACKGROUND ART

Several different arrangements are already known for joining sheets or panels edge-to-edge in a display system or arrangement by utilising a magnetic attractive force.

Several ways of combining pictures and text having dimensions considerably larger than the dimensions of a single utilised sheet or panel, for the purpose of providing information are already known and, with reference to the present invention, it should be mentioned that it is already known to join a plurality of such panels edge-to-edge with the aid of magnetised strip arrangements initiating the requisite magnetic attractive forces towards each other.

More specifically it is in this respect known for a first edge portion of a first panel to be detachably joined to a second edge portion of a second panel, a first permanently magnetised strip being applied to said first edge portion and a second permanently magnetised strip being applied to said second edge portion, and the magnetised strips being assigned such magnetisation directions in relation to each other that, in a position where the edge portions are in proximity and/or co-operating with each other, they assume a position firmly attracted to each other, said strips consisting of a composite material different from the material of the panels or the sheets and with the strips attached by means of adhesive to said edge portions of the panel.

In this connection it is known to use a PVC material for the material of the panel, which has a modulus of elasticity of approximately 2600 MPa (megapascal or $N/m^2$) and to use an elastic plastic material for the magnetised strip or magnetic strip (1.7×6 mm), which has a modulus of elasticity of approximately 30–35 MPa.

In this respect the magnetic strips pertaining to the panel are suited for mechanical and magnetic co-operation with rails or support points located behind them which are also assigned permanent magnetisation or a magnetically attracting metal In connection with this arrangement it is thus already known to utilise permanently magnetised strips having a thickness dimension lying usually within the range of about 1.5 to 2.0 mm and having a width dimension between approximately 6 and 12 mm.

These permanently magnetised strips may be polarised in sections 1.5 mm wide or may be N-S polarised in the transverse direction.

It is already known that when a panel is to be rolled up, if one or both lengthways edge portions have been provided with magnetised strips of such thickness, the inner rolling radius for the panel must be rather large so that tensile and compressive forces, as well as axial stress related forces in the edge portions of the panel and the magnetised strip and the attachment means used, will not cause such high stresses that plastic deformation occurs or that the attachment means used slips or is released from its attachment to the panel.

It is also obvious that the spiral shape produced when the panel is rolled up acquires a pitch which is at least dependent on the thickness of the strip and of the panel. Thin panels in particular are extremely difficult to handle when fully rolled up since they become heavy at the end or edge due to the weight of the magnetic strips.

It is also known per se that a maximised magnetic attractive force between the edge portions of the panels must be sufficiently strong to cause these edge portions to abut each other tightly even in the event of slight forces being exerted on the exposed surfaces of the panels.

The magnetic attractive force necessary for this is well tested and thus known.

Taking into consideration the specifics associated with the present invention it may also be mentioned that it is known per se to apply relatively thick magnetic strips (e.g. 1.5–2.0 mm) to the laterally oriented edge portions of one or more sheets or panels so that adjacent sheets can be aligned edge-to-edge without, or substantially without any obvious join between the sheets and where the magnetic attractive force is developed between N/S and S/N magnetised magnetic strips in the transverse direction. Magnetic strips having a thickness of 1.5 to 2.0 mm and a width of 6–12 mm can thus act towards each other edge-to-edge or end surface to end surface.

Display arrangements of this design, to which the present invention is particularly directed, are sold under the description of goods or trademark "Chronoexpo 2", the deign of which is disclosed on "Internet" (Http://www.chronoexpo.com/site/index.html)

Account of the Present Invention

Technical Problems

Taking into consideration the fact that the technical deliberations one skilled in the art must perform in order to offer a solution to one or more of the technical problems posed are initially an insight into the measures and/or the sequence of measures to be taken and a choice of the means required, and on the basis thereof, the following technical problems are no doubt relevant when producing the present invention.

Taking into consideration the state of the art, as described above, it should be deemed a technical problem in an arrangement enabling edge-to-edge joining, by means of a magnetic attractive force, of a first edge portion of a first panel in a display system to a second edge portion of a second panel, to be able to create such prerequisites that a panel with magnetised strips applied to one edge portion or both edge portions can be rolled in a tight spiral to cylindrical shape (substantially cylindrical shape) having a considerably smaller least diameter than that offered in previously known panels having magnetised strips applied on one edge portion or both edge portions and which shall be rolled up or unrolled from this cylindrical shape to produce a flat orientation.

A technical problem also exists in being able to create such prerequisites that the pitch for spirally rolling the panel with magnetised strips applied, to cylindrical shape, can be chosen considerably less than has been previously possible.

It is furthermore a technical problem to be able to create such prerequisites that a panel with edge-related magnetised strips or thin magnetic strips can be rolled onto a roller-blind rod or rolled up for transportation without a rod but with a relatively small least diameter, e.g. about 10–30 mm.

A technical problem is also entailed in being able to perceive the significance of and advantages associated with, utilising thin magnetic strips, still being able to create prerequisites for sufficiently high magnetic attractive force between the edge portions of the panels and/or the edge surfaces of adjacent magnetic strips, which high attractive force can join with or somewhat exceed the attractive force that the end portions of thick magnetic strips are known to be able to offer.

A technical problem is also entailed in being able to create such prerequisites that, when said magnetised strips consist of a material different from the material of the panel, conditions shall be created in a attachment means or a layer for relatively low axial stress, in spite of a small radius of curvature having been selected for the panel on which the magnetised strip or strips is/are applied.

A technical problem is also entailed in being able to perceive the significance of and advantages associated with choosing the modulus of elasticity and the thickness of the material in said panel and the modulus of elasticity and the thickness of the material in said permanently magnetised strips in relation to each other so that axial stress appearing will be small or non-existent for the forces that will act within the area of the attachment means or the layer.

A technical problem is also entailed in being able to perceive the significance of and advantages associated with, in a panel of previously known type suitable for a display system, being able to create such prerequisites that the permanently magnetised strips can be thin and in any case assigned a thickness of less than 1.0 mm.

A technical problem is also entailed in being able to perceive the significance of and advantages associated with selecting the thickness of the permanently magnetised strip as 0.2–0.8 mm, preferably 0.6–0.75, e.g. about 0.7 mm.

It should also be deemed a technical problem to be able to create a magnetic strip from a resilient plastic material or plastic compound having a modulus of elasticity exceeding 60 MPa and normally less than 200 MPa, where the magnetic field strength is generated by a magnetised granular material of the metal neodymium or equivalent.

A technical problem is also entailed in being able to perceive the significance of and advantages associated with selecting the magnetisation direction of the strip N-S in the thickness or transverse direction of the strip.

A technical problem is also entailed in being able to perceive the significance of and advantages associated with choosing the same magnetisation direction along the whole length of the strip.

A technical problem is also entailed in being able to perceive the significance of and advantages associated with said strip, independently of its use, consisting of a strongly magnetic section and a non-magnetic section, and with an adhesive means extending over these two sections.

A technical problem is also entailed in being able to perceive the significance of and advantages associated with allowing the magnetic section to be strip-edge-related and arranged to offer sufficient magnetic attractive force, which can be achieved by the magnetised section covering less than ⅓ of the width of the strip.

A technical problem is also entailed in being able to perceive the significance of and advantages associated with choosing the magnetic section to be greater than 10% of the width of the strip.

A technical problem is also entailed in being able to perceive the significance of and advantages associated with allowing a first strip magnetised in N-S direction to be assigned a colour deviating from the colour of the second strip magnetised in S-N direction.

Solution

The present invention is based on an arrangement enabling edge-to-edge joining, by means of a magnetic attractive force, of a first edge portion of a first panel in a display system to a second edge portion of a second panel, a first magnetised strip being applied to said first edge portion and a second magnetised strip being applied to said second edge portion, the magnetised strips being assigned such magnetisation directions that, in a position where the edge portions are in proximity and/or co-operating with each other, they assume a position attracted to each other, and said strips consisting of a material different from the material of the panel and with means attaching the strip to the panel attached close to said edge portions.

In such an arrangement, specifically to solve one or more of the technical problems listed above, the present invention advocates that the modulus of elasticity and the thickness of said panel and the modulus of elasticity and the thickness of said strips shall be such in relation to each other that only small axial stress related forces, or none at all, will act within said attachment means, and that said strips shall be assigned a thickness suitable for this purpose that shall in any case be less than 1.0 mm.

As proposed embodiments falling within the scope of the present invention it is recommended that the modulus of elasticity for said panel may be selected for a plastic material within the range of 2000 to 3500 MPa and/or that the modulus of elasticity for said magnetic strips may be selected within the range of 60–200 MPa.

The present invention also advocates that the thickness of the strip may be selected as 0.2–0.8 mm and contain magnetic granular material of the metal neodymium.

Particularly recommended is for the magnetisation of one strip to be selected N-S in the transverse direction and for the same magnetisation direction to be chosen along the whole length of the strip.

The invention further recommends, independently of the application mentioned above, that said magnetic strip shall consist of a first magnetic section and a second non-magnetic section, the magnetic section may in the application referred to above be strip-edge-related.

The strip arrangement having two sections may be designed to cover less than ⅓ of the width of the strip.

The invention recommends that, when neodymium magnets are used, the magnetic section shall be chosen greater than 10% of the width of the strip.

The invention recommends assigning different colours for the first magnetised strip and the second magnetised strip.

It is also recommended that the attachment means used shall consist of an adhesive layer covering said section.

Advantages

The advantages that may primarily be deemed to characterise an arrangement in accordance with the present invention are that prerequisites are thereby created to assign a panel in a display system a rolled-up state wherein the radius of curvature can be chosen considerably smaller than the radius of curvature applicable for conventional rollable panels and wherein a modulus of elasticity and a thickness of said panel and a modulus of elasticity and a thickness of the magnetised strip or strips are such in relation to each other that only small axial stress related forces, or none at all, will act within said attachment means used.

It is furthermore advocated that the magnetised strip should be assigned a thickness which, at least in normal cases, shall be less than 1.0 mm.

Furthermore a strip arrangement having two sections may be used and the cost for the production of such a magnetic strip is less than for a full magnetic strip arrangement yet the adhesive attachment force may be the same.

The features primarily considered characteristic of an arrangement in accordance with the present invention are specified in the characterising part of claim 1.

BRIEF DESCRIPTION OF THE DRAWINGS

The basic prerequisites for an arrangement enabling edge-to-edge joining, by means of magnetic attractive force, of a first edge portion of a first panel in a display system to a second edge portion of a second panel, and an arrangement employing the principles of the invention, for a purpose exemplified, will be described with reference to the accompanying drawings in which:

FIG. 1 shows a view seen from the side of a "beam" with rectangular cross section, and the axial stress related forces occurring, and how a neutral plane or layer is centrally located, FIG. 2 shows in similar manner to FIG. 1 a panel with a magnetised strip applied, and the axial stress related forces occurring, under equivalent circumstances to FIG. 1, FIG. 3 shows in perspective the application of a first panel on a stand from fully rolled-up state to a flat, unrolled state, FIG. 4 shows in perspective two flat panels designed to be brought to a position in which they co-operate with each other, and where the significant features of the present invention are clearly revealed, FIG. 5 shows, in enlarged scale, the positions of the first edge portion of a first panel and the second edge portion of a second panel immediately prior to their achieving permanent maximum magnetic co-operation, FIG. 6 shows in perspective a permanently magnetised strip as a first embodiment, FIG. 7 shows in similar perspective a permanently magnetised two section strip as a second embodiment, FIG. 8 shows a spirally rolled panel with magnetised strips of conventional design, and FIG. 9 shows a spirally rolled panel with magnetised strips designed in accordance with the invention.

DESCRIPTION OF PROPOSED EMBODIMENT

To start with, the axial stress related forces occurring when a "beam" B having rectangular cross section is subjected to stresses through bending or, in the present case rolling up or unrolling, will be described with reference to FIG. 1.

In this application a neutral plane or layer 2*a* will be located centrally. The axial stress forces "N–" and "N+" are here symmetrically distributed about the neutral layer 2*a* and increase in upward or downward direction therefrom.

FIG. 2 is intended to illustrate the distribution of the axial stress forces for a panel 1 designed in accordance with the principles of the invention where, for the sake of clarity, we have chosen to illustrate the invention and the axial forces occurring by selecting a thickness of 02. mm and a modulus of elasticity of 2600 MPa for the panel 1, to which is attached a magnetic strip 2 selected here with a thickness of 0.7 mm and a modulus of elasticity of 150 MPa.

The neutral layer 2*b* for this combination will be situated at a distance "h" from the opposing surfaces 1' and 2' shown there. This distance "h" is here 0.2–0.176=0.024 mm.

FIG. 2 illustrates the distribution of the axial stress forces when the panel 1, with a magnetised strip 2 applied, is bent convexly with the panel 1 on the outside.

Since the panel 1 consists of a material, a screen, a sheet of PVC, a paper or other relatively stiff material, having a modulus of elasticity that, in accordance with the invention, shall fall within the range of 2000 to 3500 MPa which far exceeds the modulus of elasticity of 60–200 MPa for the magnetised strip 2 produced from a composite, FIG. 2 is intended to illustrate that the neutral layer, designated 2*b*, has been displaced towards the lower surface 1' of the panel 1. This surface 1' co-operates, via an adhesive layer 3, with an upper surface 2' assigned to the magnetised strip 2.

For one skilled in the areas of design calculations and strength of materials calculations it is known to mathematically evaluate the neutral layer 2*b* where axial stress related forces are zero or close to zero.

With the large differences in modulus of elasticity in question here, e.g. 2000–3500 MPa for the panel 1 and 60–200 MPa for the magnetic strip 2, an appropriate slight displacement of the neutral layer 2*b* occurs towards the adhesive layer 3.

The magnetised strip shall still be chosen from a soft, resilient material (small modulus of elasticity) and although the limit values stated, 60–200 MPa, are considerably larger than the known modulus of elasticity (33 MPa), it is probably suitable to select a modulus of elasticity of between 80 and 150 MPa, e.g. 90–120 MPa.

It is also obvious that the absolute magnitude of the axial stress forces stated in FIG. 2 is dependent on the magnitude of the moment, to which it is submitted, i.e. on the radius of curvature when the panel is rolled.

The transverse force here can be theoretically neglected with constant bending or radius of curvature since no shear stresses occur in this application.

It should also be noted that any force acting within the adhesive layer 3 can cause the magnetic strip 2 to be displaced in relation to the panel 1, or vice versa, resulting in considerable difficulty when the panel is to assume a flat state in which the magnetic strip 2 and panel 1 must resume the state in which they are able to expose their message.

Of significance to the present invention is thus the insight that a neutral layer 2*b* for a specific case of bending will, upon a selected increase in modulus of elasticity for the panel 1 in relation to the modulus of elasticity of the magnetised strip 2, be displaced towards the limit surfaces 1' and 2' and that the closer the neutral layer 2*b* will be to the adhesive layer 3.

The present invention thus offers an arrangement "A" based on a well-balanced co-ordination between the modulus of elasticity and thickness (2600 MPa; 0.2 mm) of the panel 1 and the modulus of elasticity and thickness (150 MPa; 0.7 mm) of the magnetised strip 2 in order, by observance of these factors, to cause forces occurring in the layer 3 to be selected to 0 or at least close to 0.

Thanks to this dimensioning rule axial stress related forces in the layer 3 will be slight.

FIGS. 3 and 4 show a general arrangement enabling edge-to-edge joining, by means of a magnetic attractive force, of a first edge portion 11*a* of a first panel 11 in a display system 10 to a second edge portion 12*b* of a second panel 12.

A first magnetised strip 11*e* is applied on said first edge portion 11*a* and a second magnetised strip 12*d* is applied on said second edge portion 12*b*. The magnetised strips are assigned such magnetisation directions in relation to each other that, in a position not shown in FIG. 4 but intimated, where the edge portions are in proximity and/or in co-operation with each other they are able to assume a position where they are maximally attracted to each other and fixed in relation to each other.

FIG. 4 is intended to show that a panel 11 (or 12) that has been rolled up to a spiral about a roller-blind rod situated below in a base part, and has been stored in this rolled-up state for an extended period of time, can be unrolled and secured to the upper part of a stand, thereby producing a flat surface.

FIG. 3 is intended to show that a panel 11 that has been rolled up to a spiral as shown in FIG. 9, and has been stored in this rolled-up state for an extended period of time, can be secured to the upper part of a stand and be allowed to drop down and be secured to a base part, thereby producing a flat surface.

Said strips 11*e*, 12*d* here consist of a composite material containing plastic and the properties of this material can be adjusted to requirements set, as well as being different from the material of the panel and its properties, and with attachment means pertaining to the strip secured close to said edge portions of the panels 11, 12, respectively.

The description of these fixing media, which may have an application different from the technical field mentioned above, is specified in more detail in FIG. 5 where said magnetised strip 11*e* is secured to one edge portion of the panel 11 and said magnetised strip 12*d* is secured to the edge portion of said panel 12.

A fundamental condition of the present invention is that the modulus of elasticity and the thickness of said panels 11, 12, respectively, and the modulus of elasticity and the thickness of said strips 11*e*, 12*d* are so adjusted in relation to each other as described above that only small axial stress related forces, or none at all, will act within said attachment means 3 or between the surface layers 1', 2' shown in FIG. 2.

In order to fulfil the requirement of only small forces, or none at all, in the attachment means 3 and acceptable forces within the magnetised strip, the present invention also recommends that said strips 11*e*, 12*d* shall be assigned a small thickness "d" and in any case the thickness shall in practice be less than 1.0 mm.

The thickness of the panel 11 is normally selected as thin as circumstances permit so as to enable satisfactory rolling, and in practice a thickness "a" of less than 0.2 mm should be feasible.

A thickness of 0.1 is sufficient for many applications. However, the panel should be strong enough to withstand tearing.

The ratio "d/a" is largely dependent on the modulus of elasticity selected for the panel and the magnetised strip. Ratios within the range 15:2 may be considered suitable, preferably between 5:6, e.g. 3:4.

The thickness "d" of the magnetised strip 11, 12, respectively shall be chosen as small as possible since the magnetic strips shall have sufficient maximised magnetic attractive force for the application in question.

It may be mentioned here that the attractive force is dependent on the proportion of magnetised granular material mixed into a plastic compound. The attractive force can therefore be increased by increasing the proportion of granular material.

In practice the thickness "d" may be chosen as 0.2–0.8 mm with a granular material containing neodymium magnets or the like.

Values within the range 0.5–0.8, e.g. about 0.7 mm, have been found suitable in many practical applications.

In accordance with the invention the magnetisation direction shall be selected S-N for the strip 11*e* and N-S for the strip 12*d*, enabling co-operation between the strips 11*e* and 12*d* to acquire a predetermined direction, ensuring that upper surfaces 11' and 12' of the panels 11, 12, respectively, will be aligned with each other.

The same magnetisation direction is chosen along the whole length of the strip, as illustrated in FIGS. 6 and 7.

FIG. 6 shows that said strip 11*e* shall consist of a homogenous, magnetised plastic material and comprise a unit with an adhesive surface 50 for adhesion to the lower surface 11' of the panel 11.

FIG. 7 shows that said strip, e.g. the strip 12*d*, may consist of a first, a homogenous magnetic, section 12*e* and a second, a non-magnetic section 12*f*, thereby reducing the costs of magnetisation and the magnetic material required while still retaining a sufficiently large adhesive area 51 to co-operate with the lower surface 12' of the panel 12. A magnetic strip arrangement having three or more sections falls also within the inventive idea of the present invention.

It seems natural for the embodiment according to FIG. 6 to have one and the same modulus of elasticity across its entire cross section. However, measures may be required to fulfil this requirement for the embodiment according to FIG. 7.

These measures may entail different quantities of plasticizers to be added for the sections 12*e* and 12*f*.

The magnetic section 12*e* is strip-edge-related and designed to cover less than ⅓ of the width "b" of the strip. It is preferably chosen to cover more than 10% of the width "b" of the strip.

The first magnetised strip 11*e* is thus magnetised in a first edge-oriented direction S-N and the second magnetised strip 12*d* is magnetised in a second edge-oriented direction N-S and, to enable visual differentiation of said strips, it is recommended that they are assigned different colours so that a join between one edge portion 11*a* of a first panel 11 and a second edge portion 12*b* of a second panel 12 can be created without misunderstanding.

Although the attachment means 3 on the surfaces 50 and 51, respectively, may advantageously consist of an adhesive layer covering said section, means other than an adhesive layer also fall within the scope of the invention.

FIG. 8 shows in perspective a panel rolled maximally to a spiral and having a thickness of 0.2 mm, with magnetised strips 1.7 mm thick, and having a modulus of elasticity of 33 MPa.

FIG. 9 shows in perspective a panel rolled maximally to a spiral and having a thickness of 0.2 mm, with magnetised strips designed in accordance with the invention 0.7 mm thick, and having a modulus of elasticity of 100 MPa.

The invention thus recommends the ratio between the modulus of elasticity assigned to panel and strip to be adjusted in relation to each other to fulfil the ratios stated in the description and offer the technical effects associated with the invention.

The values stated for modulus of elasticity relate primarily to plastic material and the principles of the invention can also be utilised for other materials, reinforced or not reinforced.

FIG. 2 shows the orientation of a neutral layer 2*b* when a plastic panel (PVC plastic) 0.2 mm thick and with a modulus of elasticity of 2600 MPa is bent together with a magnetic strip, assigned a thickness of 0.7 mm and with a modulus of elasticity of 150 MPa.

It is now obvious that a higher modulus of elasticity (say 200 MPa) for the magnetic strip will raise the neutral plane 2*b*, and vice versa.

A higher modulus of elasticity (say 3000 MPa) for the panel will also raise the neutral plane 2*b*, and vice versa.

The magnetised strip in accordance with FIG. 6 can preferably be manufactured by extruding a plastic compound containing neodymium material through a nozzle and providing a magnetising unit in conjunction with the nozzle, inside or downstream thereof, to assign the neodymium material its magnetisation direction during the solidification process, which may include a cooling stretch.

The magnetised strip in accordance with FIG. 7 is somewhat more complex. The section 12*e* can be manufactured as described above whereas the section 12*f* can be manufactured using conventional methods.

The boundary layer 12*g*, however, must integrate the two sections 12*e*, 12*f* so that a homogenous magnetic strip is extruded.

The invention is naturally not limited to the embodiment described above by way of example. It can be modified within the scope of the inventive concept illustrated in the appended claims.

What is claimed is:

1. An arrangement for enabling edge-to-edge joining by a magnetic attractive force, of a first edge portion of a first panel in a display system to a second edge portion of a second panel, a first magnetized strip being applied to said first edge portion and a second magnetized strip being applied to said second edge portion, the first and second magnetized strips being assigned magnetization directions that, in a position where the edge portions are in proximity and/or co-operating with each other, the first and second magnetized strips assume a position attracted to each other, the first and second magnetized strips are of a material different from the material of the panel, and have means for attaching the first and second magnetized strips to the panel, the first and second magnetized strips being oriented close to said edge portions and said means for attaching being in the form of an adhesive layer, characterized in that the modulus of elasticity and the thickness of said panel and the modulus of elasticity and the thickness of the first and second magnetized strips is such, relation to each other, that only small axial stress related forces, or none at all, will act within said attaching means or adhesive layer during a rolling up sequence, and wherein the first and second magnetized strips each is assigned a uniform thickness of less than 1.0 mm.

2. The arrangement as claimed in claim 1, wherein the modulus of elasticity for said first and second panels is selected within the range of 2000 to 3500 MPa.

3. The arrangement as claimed in claim 1, wherein the modulus of elasticity for said first and second strips is selected within the range of 60–200 MPa.

4. The arrangement as claimed in claim 1, wherein the thickness of said first and second strips is selected as 0.2–0.8 mm and contains neodymium magnetic granular material.

5. The arrangement as claimed in claim 1, wherein the magnetization of one strip is selected N-S and in a transverse direction S-N for said second strip.

6. The arrangement as in claim 1, further comprising a strip part of each said strip assigned a magnetization direction that is chosen along the whole length of the strip.

7. The arrangement as claimed in claim 1, wherein said first magnetized strip and said second magnetized strip are assigned different colors.

* * * * *